US008503901B2

(12) United States Patent
Akita et al.

(10) Patent No.: US 8,503,901 B2
(45) Date of Patent: Aug. 6, 2013

(54) IMAGE FORMING APPARATUS WITH A TONER CONTAMINATION DETECTING DEVICE

(75) Inventors: Hiroshi Akita, Musashino (JP); Seiko Itagaki, Hachioji (JP); Natsuko Minegishi, Hachioji (JP); Hiroyuki Saito, Itabashi-ku (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 365 days.

(21) Appl. No.: 12/877,548

(22) Filed: Sep. 8, 2010

(65) Prior Publication Data

US 2011/0058843 A1 Mar. 10, 2011

(30) Foreign Application Priority Data

Sep. 9, 2009 (JP) ..... 2009-207903
Sep. 9, 2009 (JP) ..... 2009-207904
Sep. 10, 2009 (JP) ..... 2009-209075

(51) Int. Cl.
*G03G 21/00* (2006.01)

(52) U.S. Cl.
USPC ..... 399/98; 399/99; 399/100; 399/296

(58) Field of Classification Search
USPC ..... 399/98–101, 296
See application file for complete search history.

(56) References Cited

U.S. PATENT DOCUMENTS 5,481,345 A * 1/1996 Ishida et al. ..... 399/296
5,532,798 A * 7/1996 Nakagami et al. ..... 399/100
5,557,373 A * 9/1996 Miyashita et al.
5,923,922 A * 7/1999 Ishida et al. ..... 399/98
6,029,029 A * 2/2000 Danzuka ..... 399/100

FOREIGN PATENT DOCUMENTS

JP 61084658 A * 4/1986
JP 61205962 A * 9/1986
JP 4-372964 A 12/1992
JP 6-274040 A 9/1994
JP 06250513 A * 9/1994
JP 11125939 A * 5/1999
JP 2011007916 A * 1/2011

* cited by examiner

*Primary Examiner* — David Gray
*Assistant Examiner* — Laura Roth
(74) *Attorney, Agent, or Firm* — Buchanan Ingersoll & Rooney PC

(57) ABSTRACT

An image forming apparatus includes: an image carrier; a latent image forming device; a developing device; an electrode which faces to the image carrier; an electric power source, a toner contamination detecting device for detecting toner contamination onto the electrode; an electrode cleaning device for cleaning the electrode; and a controlling section. The control section controls the electric power source to apply at least an alternating current voltage to the electrode so that toner image is rearranged by reciprocally moving toner of the toner image between the image carrier and the electrode control section and allows the electrode cleaning device to clean the electrode when the toner contamination detecting device detects toner contamination on the electrode, and performs the toner rearrangement by the electrode from which the toner contamination is removed.

17 Claims, 17 Drawing Sheets

IMAGE FORMING APPARATUS WITH A TONER CONTAMINATION DETECTING DEVICE

RELATED APPLICATION

This application is based on Japanese Patent Application NO. 2009-207903 filed on Sep. 9, 2009 in Japanese Patent Office, Japanese Patent Application NO. 2009-207904 filed on Sep. 9, 2009 in Japanese Patent Office, and Japanese Patent Application NO. 2009-209075 filed on Sep. 10, 2009 in Japanese Patent Office, the entire content of which is hereby incorporates by references.

TECHNICAL FIELD

The present invention relates to an image forming apparatus for forming an image on a recording medium by electrophotographic process.

TECHNICAL BACKGROUND

In the electrophotographic process, as commonly known, an electrostatic latent image is formed on an image carrier and the fanned latent image is developed to form a toner image. Thus formed toner image is transferred onto a recording medium such as paper.

Highly definitional expression of photographic images and patterns can be realized accompanied with increase in image quality, particularly that of color image.

However, a problem of roughening of the image, particularly at medium density portion of the image, is caused when the quality of the photographic image or pattern image is increased.

It is proposed in Patent Documents 1 and 2 for inhibiting the roughening of image to provide an electrode facing to the image carrier on the downstream side of the developing device and alternative electric voltage is applied to the electrode for reciprocally moving the toner between the image carrier and the electrode.

It is considered that the roughening of the image is caused by formation of ununiformity of the toner at the portion of the image where the toner is to be uniformly distributed. In Unexamined Japanese Patent Application Publication No. 4-372964 and Unexamined Japanese Patent Application Publication No. 6-274040, the toner distribution is made uniform by the reciprocal movement of the toner for inhibiting the roughening.

Problems to be Solved by the Invention

When the plane image such as the photographic image or the pattern image is developed by a magnetic brush developing system, sweeping marks formed by partially excessive distribution of the toner is caused other than the roughening described in Unexamined Japanese Patent Application Publication No. 4-372964 and Unexamined Japanese Patent Application Publication No. 6-274040.

In Unexamined Japanese Patent Application Publication No. 4-372964 and Unexamined Japanese Patent Application Publication No. 6-274040, the image is restored by the reciprocal movement of the toner for inhibiting the roughening of the image and improving the image quality. In this technology, the roughening is prevented by making uniform the distribution of the toner adhering on the image carrier by rearranging the toner by reciprocally moving the toner by the acting of alternative voltage. It is necessary for preventing the foregoing sweeping marks and roughening to apply the alternative voltage in the state that the contamination of toner on the electrode is not caused.

In Unexamined Japanese Patent Application Publication No. 6-274040, the roughening is prevented by controlling the relation between the peak value and the frequency of the alternative voltage applied to the electrode, the potential of the image contrast and the distance between the image carrier and the electrode. However, there is no description regarding the contamination of the toner to the electrode. Therefore, the controlling of the alternative voltage is not related of course to the contamination of the toner onto the electrode in Unexamined Japanese Patent Application Publication No. 6-274040. Accordingly, the phenomenon to lower the image quality such as the sweeping mark or the roughening cannot be sufficiently prevented. The above phenomenon cannot be prevented of course according to Unexamined Japanese Patent Application Publication No. 4-372964 which does not describe the controlling of any electrode condition.

An object of the invention is to provide an image forming apparatus by which the formation of sweeping marks and the roughening caused on the occasion of forming the two dimensional image such as the photographic image and the pattern image can be prevented so that the high quality images can be stably formed.

SUMMARY OF THE INVENTION

To achieve at least one of the above mentioned objects, an image forming apparatus for forming an image based on image data reflecting one aspect of the present invention comprises: an image carrier; a latent image forming device for forming an electrostatic latent image on the image carrier; a developing device for developing the electrostatic latent image carried on the image carrier to form a toner image on the image carrier; an electrode which is arranged downstream of the developing device in a moving direction of the image carrier and faces to the image carrier, an electric power source which applies a voltage comprising an alternating current voltage to the electrode, a toner contamination detecting device for detecting toner contamination onto the electrode; an electrode cleaning device for cleaning the electrode; and a controlling section, wherein the control section controls the electric power source to apply a voltage comprising an alternating current voltage to the electrode so that the toner image is rearranged by reciprocally moving toner of the toner image between the image carrier and the electrode control section and allows the electrode cleaning device to clean the electrode when the toner contamination detecting device detects toner contamination on the electrode, and performs the toner rearrangement by the electrode from which the toner contamination is removed.

It is preferred that the toner contamination detecting device has a toner sensor for detecting the toner on the electrode.

It is preferred that the electrode cleaning device has a cleaning member for mechanically removing the toner on the electrode.

It is preferred that the electrode cleaning device applies a voltage comprising an alternating current voltage applied by the electric power source so as to electrically release the toner on the electrode from the electrode by the electric voltage applied by the electric power source.

It is preferred that the electrode cleaning device applies an electric voltage comprising an alternating current voltage applied by the electric power source, and the controlling section controls the electric power source according to a detected result of the toner contamination onto the electrode detected by the toner contamination detecting device so and thereby controls an electrode condition of the electrode while rearranging the toner.

It is preferred that the controlling section executes the toner rearrangement for a designated sheet number of the image by the electrode from which the toner is removed by the electrode cleaning device.

And it is preferred that the electrode has a face facing the image carrier on an occasion of the toner rearrangement, and the face is capable of being moved to a detecting position where the toner contamination is detected by the toner contamination detecting device. Further it is preferred that the face is continuously moved to the detecting position, or that the face is intermittently moved to the detecting position.

EMBODIMENTS OF THE INVENTION

<Image Forming Apparatus>

Figure 1:
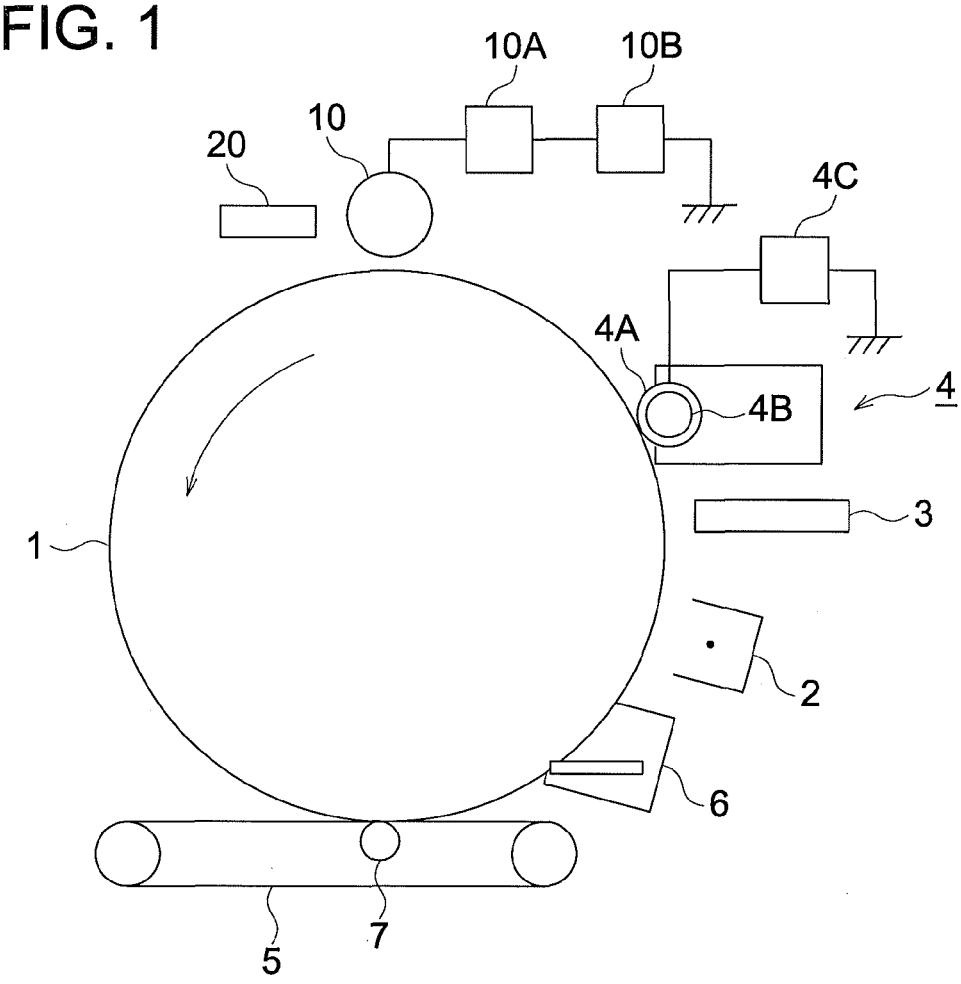
FIG. 1 shows a drawing displaying the whole constitution of the image forming apparatus relating to the embodiment of the invention.

FIG. 1 shows a drawing displaying the whole constitution of the image forming apparatus relating to the embodiment of the invention.

A photoreceptor 1, as the image carrier for carrying the electrostatic latent image and the toner image, comprises an OPC photoreceptor which has an organic photosensitive layer provided on an electro-conductive drum substrate.

2 is a charging device constituted by a scorotron charger, and 3 is an exposing device having a light source such as a laser and a light emission diode array which emits light according to image data for exposing the photoreceptor 1. The charging device 2 and the exposing device 3 constitute a latent image forming apparatus for forming latent images on the photoreceptor 1.

4 is a developing device which performs development by forming a magnetic brush by a two-component developer containing a toner and a magnetic carrier. 4A is a developing roller which is a developer carrier for transporting the developer into the developing zone and holding the magnetic brush in the developing zone.

4B is a magnetic roller as a magnetic field forming member which has plural magnetic poles such as developing magnetic poles and developing transport magnetic poles, and is arranged and fixed in the developing roller 4A.

Developing bias voltage composed of direct current voltage overlapped with alternating current voltage is applied to the developing roller 4A from an electric power source 4C.

The developing roller 4A is rotated for transporting the developer into the developing zone. In the developing zone, in which the photoreceptor 1 and the developing roller 4A are faced to each other, the magnetic brush is formed by the magnetic poles of the magnetic roller 4B and the magnet brush development is carried out. In the example shown in the drawing, the developing roller 4A is moved in the direction reverse to that of the photoreceptor 1 in the developing zone; but a developing method in which the developing roller 4A and the photoreceptor 1 are moved in the same direction can be also used.

The former is called as the reverse rotation developing method and the later is called as the regular rotation developing method.

In the developing device 4 shown in the drawing, the reverse development is performed by using a negatively charged toner for developing the electrostatic latent image formed by negatively charging.

5 is a semi-conductive transferring belt for transporting a recording material P and transferring the toner image from the photoreceptor 1 to the recording material P. A transferring voltage is applied to the transferring belt 5 by a backup roller 7 at the transferring position. 6 is a cleaning device for cleaning the photoreceptor 1.

The photoreceptor 1 is rotated in the anti-clockwise direction as shown by the arrow mark, and the electrostatic latent image is formed on the photoreceptor by the charging by the charging device 2 and exposing by the exposing device 3. In this embodiment, the photoreceptor is negatively charged and the electrostatic latent images formed by negative charge are generated. The latent image is developed by the negatively charged toner. The toner images formed on the photoreceptor 1 by the development are transferred onto the recording material P by the transferring device constituted by the transferring belt 5 and the backup roller 7. The transferred toner images are fixed to the recording material P by a fixing device (not shown in the drawing). After the transferring by the cleaning device 6, the photoreceptor 1 is cleaned.

An electrode 10 is provided on the downstream side of the developing device 4 regarding to the moving direction of the photoreceptor 1. Voltage composed by overlapping alternating current voltage and a direct current voltage can be applied to the electrode 10 from an electric power source 10A constituted by an AC power source and an electric power source 10B constituted by a DC power source.

The electrode 10, the power source 10A and the power source 10B constitute a toner rearrangement zone.

20 is a toner sensor for detecting the toner on the electrode 10.

<Toner Rearrangement>

When the toner image of the plane image such as the photographic image and the pattern image is formed by the magnetic brush development, the sweeping marks caused by the partial excessive density and the roughening caused by ununiformity of density at the portion to be uniform in the density are posed.

The sweeping mark is a phenomenon of formation of high density portion at the rear end of the image by the collected toner caused when the toner image formed on the photoreceptor when the development is rubbed by the magnetic brush. It is considered that the roughening is caused by deformation of the toner image caused when the toner image formed on the photoreceptor is rubbed by the magnetic brush.

The quality of the toner image lowered by such the phenomena can be restored by the following toner rearrangement.

The toner rearrangement is a treatment for reciprocally moving the toner constituting the toner image between the electrode 10 and the photoreceptor 1 when the toner image is passed between the electrode 10 and the photoreceptor 1 by forming an alternative electric field between the electrode 10 and the photoreceptor 1. The distribution of the toner forming the plane image is made uniform by the reciprocal moving. As a result of that, the sweeping marks and the roughening are restored so that the high quality image can be formed. In the toner rearrangement process, at least alternating current voltage is applied to the electrode 10, and a direct current voltage may be overlapped to the alternative voltage.

It is important in the toner rearrangement process that the treatment is carried out in a state of that no toner is contaminating on the electrode 10. Though the state of which no toner is contaminating on the electrode 10 means that any toner is not contaminating on the electrode 10, the restoration can be performed even when a small amount of the toner exists on the electrode 10, not completely absent. The toner on the electrode 10 is detected by the toner sensor as later-described. The state of no toner on the electrode means that the difference of the output of the toner sensor from that of the sensor when the toner is completely absent is within a designated value. The designated value is decided by specific experiments.

When toner contaminates on the electrode 10, the image restoration is made insufficient, and the sweeping marks and the roughening are caused so as to lower the quality of the image.

For performing the toner rearrangement in the state without contamination of the toner on the electrode 10, it is preferred that the toner rearrangement is carried out under the state without contamination of toner onto the electrode and the condition of electrode is controlled so as to prevent the contamination of the toner. For setting such the preferable electrode condition, at least one of the peak voltage and the frequency of the alternating current voltage to be applied to the electrode is controlled. When the contamination of the toner onto the electrode 10 is detected, the condition of the electrode is controlled so as to inhibit the toner contamination.

Such the controlling is carried out by lowering the peak voltage, raising the frequency of the alternative voltage, or raising the direct current voltage to be applied to the electrode 10 having the same polarity as that of the charge of the toner.

To the electrode 10, the voltage composed of direct current voltage overlapping with alternating current voltage from the power sources 10A and 10B, and the controlling of the electrode condition for obtaining the suitable condition is performed by controlling the output of the electric power sources 10A and 10B.

Figure 2:
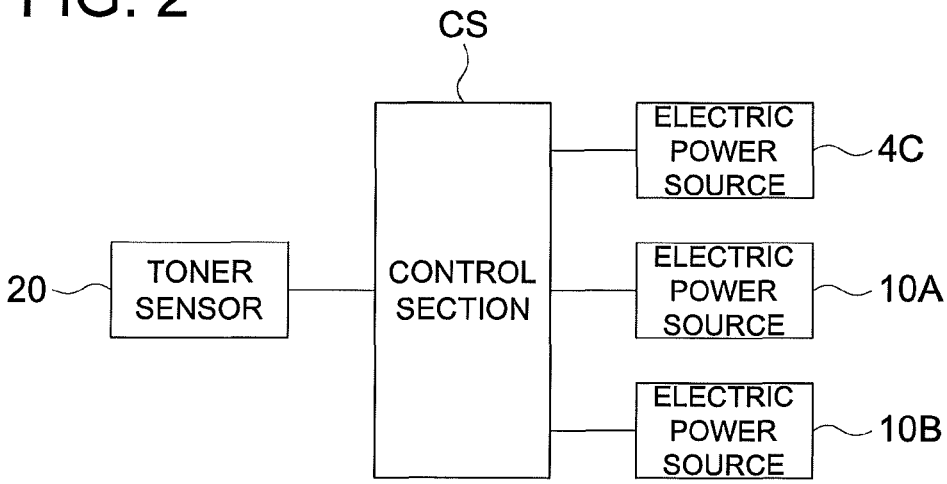
FIG. 2 shows a block diagram of the controlling system of the image forming apparatus relating to the embodiment of the invention.

FIG. 2 is a block chart of the controlling system in the image forming apparatus relating to the embodiment of the invention. In the drawing, CS is a controlling section for performing various controls including the control in the toner rearrangement and the electrode condition, by which the detected results by the toner sensor 20 are lead and the power sources 4C, 10A and 10B are controlled. Moreover, the controlling section CS judges the occurrence of toner contamination onto the electrode 10 when the variation of the output of the toner sensor 20 caused by the detection of the toner exceeds the designated value. As above-described, the toner sensor 20 and the control block CS constitute a toner contamination detecting device.

Figure 3:
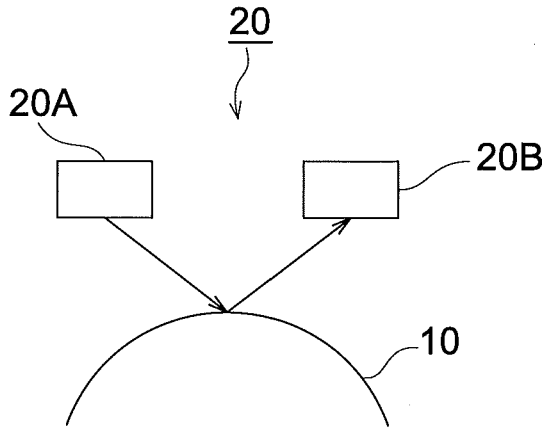
FIG. 3 shows a drawing of the toner sensor 20.

FIG. 3 shows the toner sensor 20. The toner sensor has a light emission element 20A constituted by a LED for irradiating light to the electrode 10 and a light receiving element 20B constituted by a photodiode for receiving the reflected light from the electrode 10. The concentration of the toner contaminating to the electrode 10 is continuously detected by the optical means by rotating the rod-shaped electrode 10 having circular cross section.

In the image forming process, the toner image is formed on the photoreceptor 1 by development by the developing device 4. Thus formed toner image is subjected to the toner rearrangement on the occasion of passing the position of the electrode 10. The toner moved from the photoreceptor 1 and caught on the electrode 10 is detected by the toner sensor 20. The toner on the electrode 10 is continuously detected since the electrode is clockwise rotated as displayed by the arrow mark.

In the example shown in FIG. 1, the surface of the electrode 10 facing to the photoreceptor 1 is moved by the rotation of the electrode 10 to the detecting position where the contamination of the toner is detected by the toner sensor 20.

The toner sensor 20 detects the toner at a typical position such as the central portion of the electrode 10 for example; however, the device can be constituted so that the detection is carried out at plural portions in the width direction of the electrode 10.

The controlling section CS detects the contaminating amount of the toner on the electrode 10 based on the detecting result by the toner sensor 20. The state of that no toner exists on the electrode 10 is set as the regular state, and the control block CS judges that the contamination of the toner is caused when the variation of the output of the toner sensor 20 exceeds the designated value.

The control block CS controls the electrode cleaning device so as to remove the toner on the electrode 10 when the toner contamination is caused. As the electrode cleaning device, (a) an electrode cleaning device performing mechanical removal and (b) an electrode cleaning device performing electrical removal are applicable.

As the electrode cleaning device (a) performing the mechanical removal, a cleaning member such as a blade is usable. As the electrode cleaning device (b) performing electrical removal, a device for forming an electric field for moving the toner from the electrode 10 to the photoreceptor 1 is usable. Furthermore, as the electrode cleaning device (b) for the electrical removal, a means (b1)) for releasing the toner from the electrode 10, and an electrical condition (b2) for preventing the contamination of the toner to the electrode 10 in the toner rearrangement process, are applicable.

In an example of that the photoreceptor 1 is charged at about −700 V, an direct current voltage of −1000 V and an alternating current voltage having a peak voltage of 1.3 kV and a frequency of 9 kHz are applied to the means (b1) for removing the toner from the electrode 10, so as to clean the electrode by releasing the toner from the electrode surface.

The setting of the electrode condition (b2) is carried out by the control block CS in the toner rearrangement process. The electrode condition includes the peak voltage and the frequency of the electric power source 10A for supplying the alternating current to the electrode 10 and the direct current. When the toner contamination on the electrode 10 is detected, the control block CS feedbacks the toner contamination information to the electrode condition of the toner rearrangement process and sets the electrode condition so as to prevent toner contamination on the electrode 10. In such the control of the electrode condition, control for decreasing the reciprocal motion of the toner in the toner rearrangement process such as lowering in the peak voltage of the alternating current, raising in the frequency of the alternating current and raising the voltage of the direct current having the same polarity as the charge of the toner, is carried out.

Figure 4:
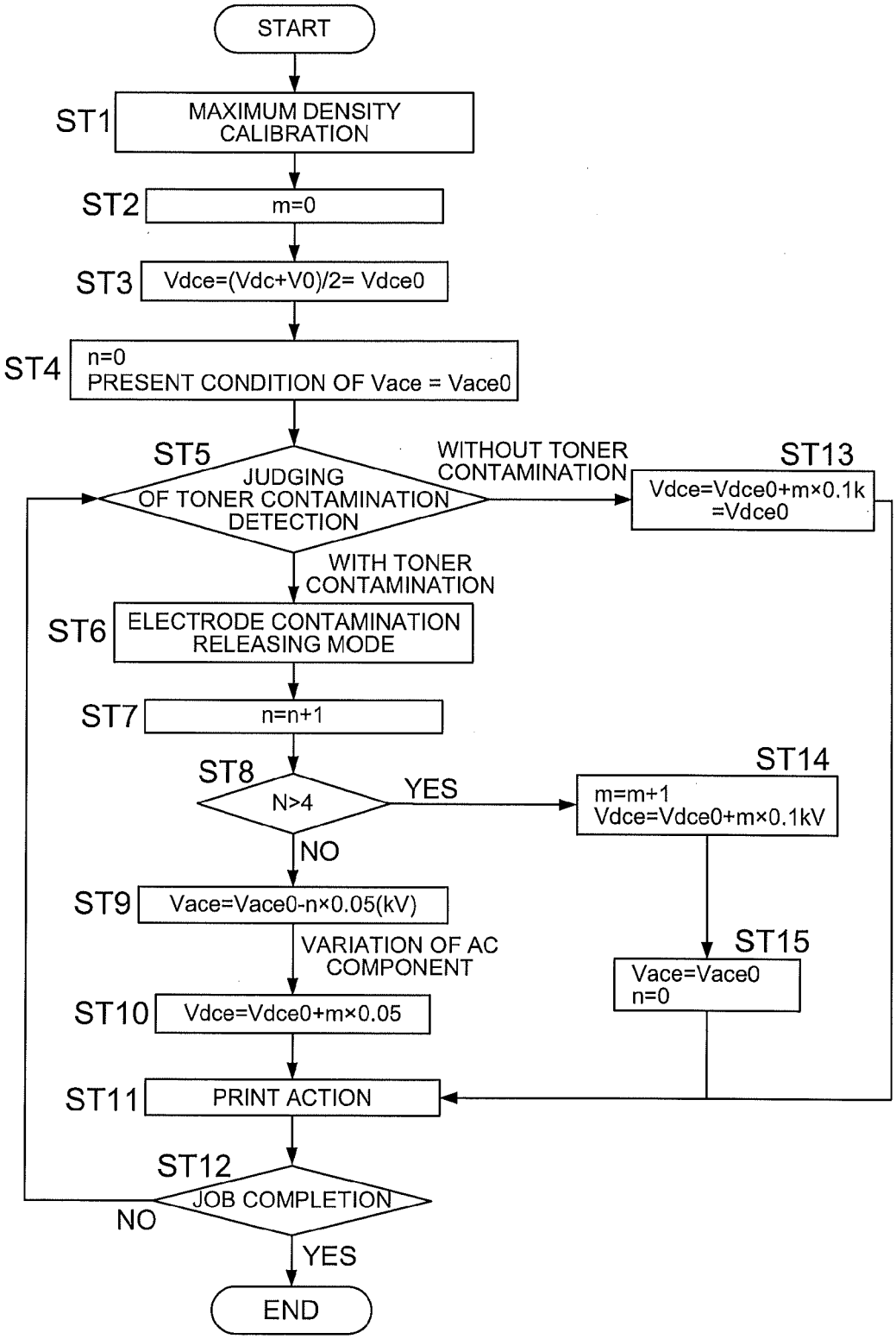
FIG. 4 shows a flowchart of the image forming process for forming an image while performing electrode cleaning and toner rearrangement.

FIG. 4 is a flowchart of the image forming process while performing the electrode cleaning and the toner rearrangement, the control of FIG. 4 is carried out by the control block CS.

On the step ST1, the maximum density calibration is carried out.

In the maximum density calibration, the direct current voltage Vdc of the developing bias is controlled by controlling the electric power source 4C of the developing device 4.

On the step ST2, the calibration coefficient m of the direct current voltage Vdc to be applied to the electrode 10 is set at the initial value 0.

On the step ST3, The direct current voltage to be applied to the electrode 10, namely the output Vdce of the electric power source 10B, is set at the initial value Vdce0. The initial value Vdce0 is set as follows based on the direct current voltage Vdc of the developing, bias.

$$Vdce0=(Vdc+V0)/2$$

On the step ST4, the peak voltage Vace of the alternating current to be applied to the electrode 10 is set at the initial value Vace0. The present value at the starting time is used as the initial value Vace0. Moreover, the calibration coefficient n of the peak voltage is set at the initial value n=0 on the step ST4, On the step ST5, occurrence or not of the toner contamination is judged.

Figure 5:
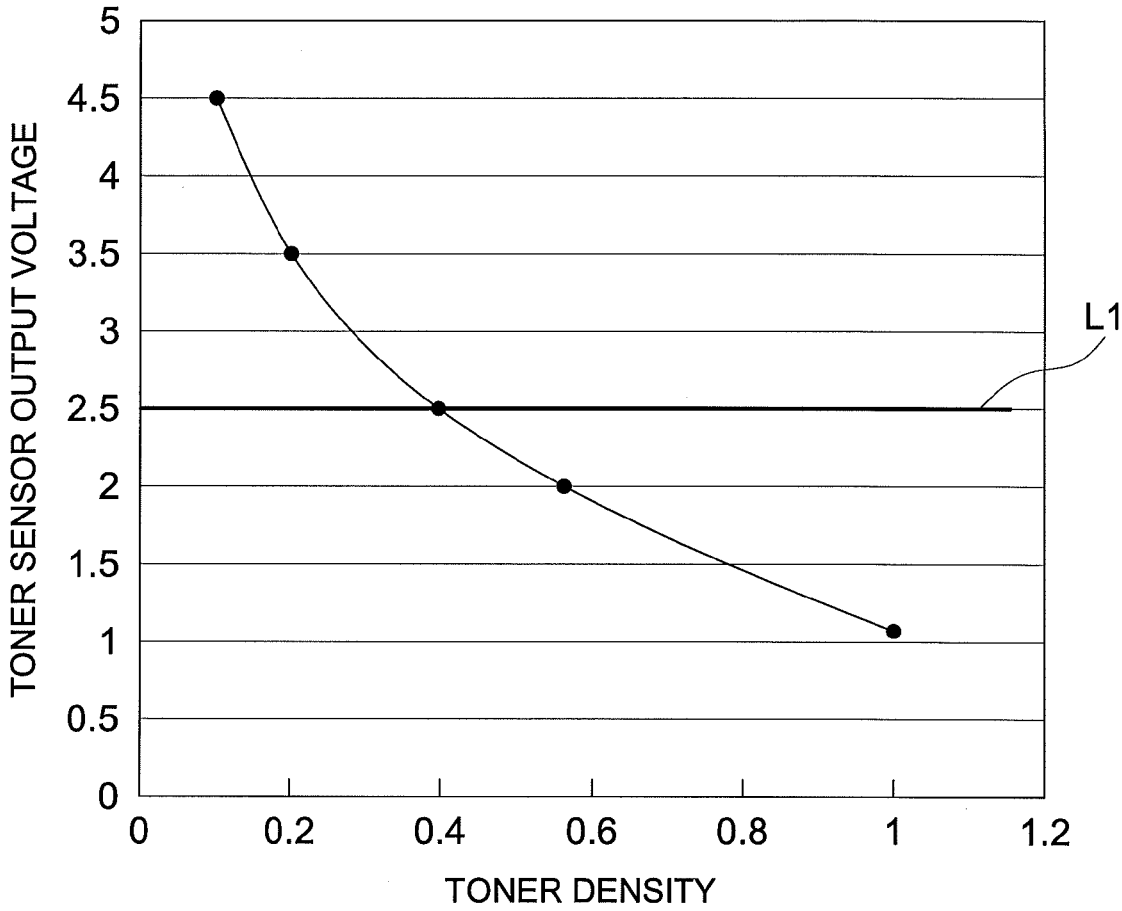
FIG. 5 shows a graph displaying the output of the toner sensor 20.

The detection of the toner contamination is carried out by detecting the toner on the electrode 10 by the toner sensor 20. FIG. 5 shows the output of the toner sensor 20. The horizontal axis expresses the concentration of the toner and the vertical axis expresses the output voltage of the toner sensor 20. The straight line L1 is the threshold value for judging of "caused or not" of the toner contamination. It is judged as that the toner contamination is not caused when the output of the toner sensor 20 is L1 (2.5 V) or more, and that the toner contamination is caused when the output is lower than the L1.

When the toner contamination is judged as "not caused" on the step ST5, the electrode conditions of Vdce=Vdce and Vace=Vace0 are set on the step ST13. Though, it is described in FIG. 4 that Vdce=Vdce+m×0.05, the direct current voltage Vdce is set at the initial value of Vdce since the calibration coefficient m is zero at the initial state.

When the toner contamination is judged as "caused" on the step ST 5, the releasing of the toner is carried out on the step ST6. On the step ST6 of the releasing of the toner, the removing of the toner is performed by transferring the toner on the electrode 10 to the photoreceptor 1. For example, alternating current of Vdce=−1000 V, Vace=1.3 kV and a frequency of 9 kHz is applied to the electrode 10. Under such the electrode condition, the toner contaminating onto the electrode 10 is transferred to the photoreceptor 1 so that the electrode 10 is cleaned. Namely, the cleaning of the electrode 10 by the electrical cleaning device is carried out in FIG. 4.

On the step ST7, the calibration coefficient n is set at n+1. On the step ST8, the process is advanced to the step ST9 when the calibration coefficient is not more than 4 ("No" on the step ST8).

On the step 9, the peak voltage Vace is controlled to Vace=Vace0−n×0.05 kV. The peak voltage is usually about some kilovolt; therefore the control unit is within the range of some percent of the peak voltage. In the control on the step ST9, the peak voltage of the alternating current component is lowered. By such the controlling, the reciprocal motion of the toner in the toner rearrangement process is decreased so that the contamination of the toner onto the electrode is inhibited.

On the step ST10, the direct current voltage Vdce is controlled so as to be Vdce=Vdce+m×0.05 kV. Such the control is described later.

The image formation is carried out on the step ST11 continuing the step ST10. The image formation is carried out together with the toner rearrangement. The toner arrangement is carried out under the electrode condition of Vace0−n×0.05 kV and Vdce=Vdce+m×0.05 kV. The image formation on the step ST11 is carried out by a unit of designated sheet number of from 1 to several tens. Accordingly, when the designated number of the image formation accompanied with the toner arrangement is carried out by the electrode 10 cleared by the toner releasing, the process is transferred to the step ST12.

When the job is finished ("Yes" on the step ST12), the process is finished, and is not finished, the process returns to ST5.

The image formation is carried out by repeat of the ST5 to ST12. In the image forming process, the lowering of the image quality is not caused by the toner contamination on the electrode 10 since the toner rearrangement is per formed by the electrode 10 subjected to the toner releasing.

The value of n is made increment at every time of the repeating of the loop of ST5 to ST12 and the peak voltage is made to a lowered value of Vace0−n×0.05 kV.

When the calibration coefficient exceeds 4 (Yes of ST8), the process is transferred to the step ST14. In the control of the transference from ST8 to ST14, the electrode condition not causing the toner contamination is set by controlling the direct current voltage to be applied to the electrode 10 when the electrode condition for not causing the toner contamination cannot be set by the control of the alternating current voltage.

On the step ST14, the direct current voltage to be applied to the electrode 10 is controlled to Vdce=Vdce0+m×0.1 kV. This control is a control for inhibiting the toner contamination onto the electrode 10 by raising the voltage of the electrode 10 with the same polarity as the charge of the toner.

On the step ST 14, the calibration coefficient m is set at m+1.

On the step ST15 continuing the step ST14, the peak voltage of the alternating current component Vace is returned to the initial value Vace0. The controlling on the steps of ST8 to ST15 is to set the electrode condition difficulty causing the toner contamination by controlling the direct current voltage and to initialize the peak value Vace of the alternating current component for re-adjusting the electrode condition, when the toner contamination cannot be cancelled by the controlling the direct current voltage. The direct current voltage Vdce is adjusted to Vdce+m×0.05 kV on ST10 by way of ST14, for example, the value Vdce is made to Vdce+2×0.05 kV when processing is passed twice through ST14.

In the case of that the calibration coefficient exceeds 4 on the step ST8, namely the electrode condition difficulty causing the toner contamination cannot be set by controlling the peak voltage Vace, the sweeping marks are frequently caused.

Figure 6:
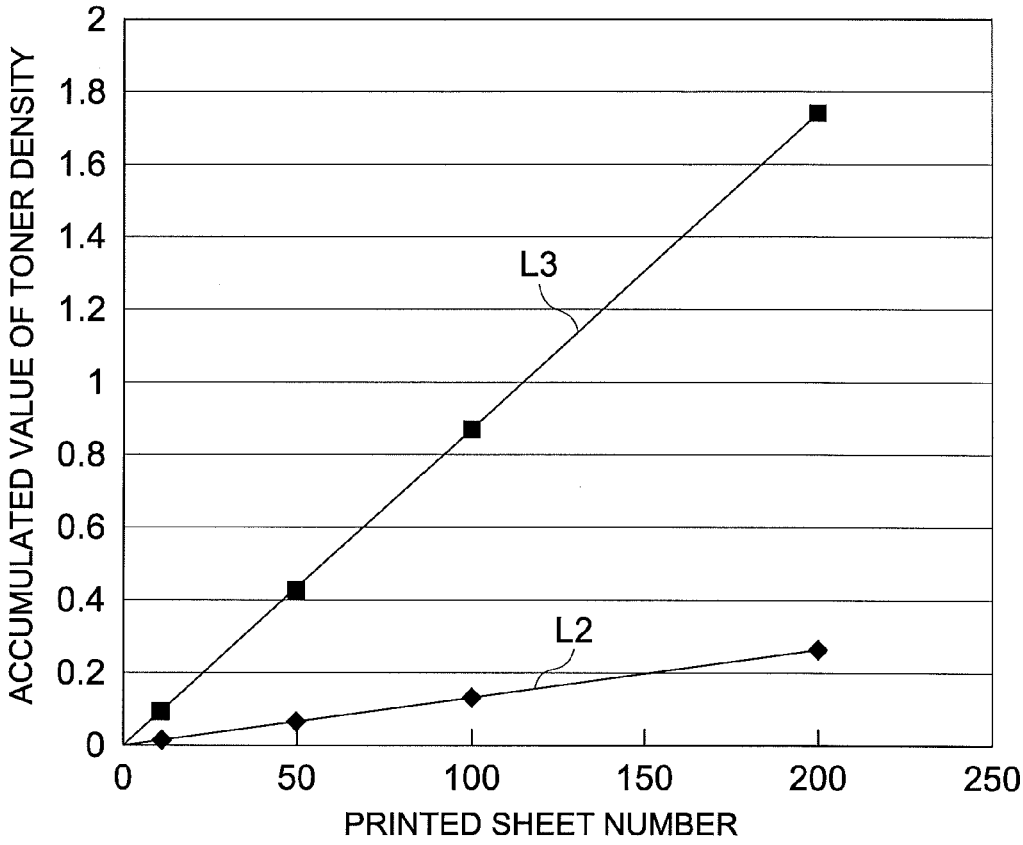
FIG. 6 shows a graph displaying the summed value of concentration detected by the toner sensor 20.

FIG. 6 shows the sum of the values of the density detected by toner sensor 20; therefore, it can be said that the FIG. 6 shows the sum of the values of the amount of the contaminating toner. The line L2 show the summed contaminating amount of the toner in the usual image formation. L3 shows the summed value when the contaminating amount of the toner is large. In the case of that the contaminating amount of the toner is large, the sweeping marks is easily caused in the image formation; however, high quality image can be formed without lowering in the image quality by performing the control by ST8, ST14 and ST15 shown in FIG. 4 even when the toner contaminating is large as shown by L3.

<Another Embodiment>

The followings are the descriptions on various embodiments of the invention. FIGS. 7 to 15 display embodiments in which various types of the electrode 10 are used.

Figure 7:
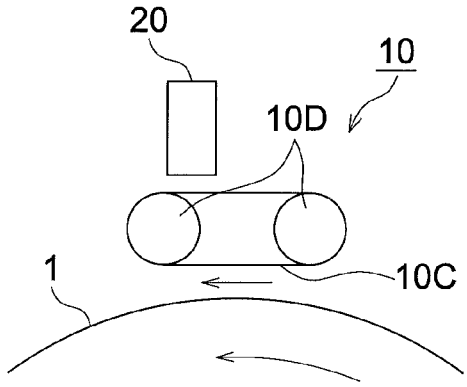
FIG. 7 shows a drawing of an example of the electrode 10.

In the example of FIG. 7, the electrode 10 comprises an electro-conductive belt 10C composed of metal or electro-conductive resin and two roller 10D holding the belt 10C. The electro-conductive belt 10C is moved in the direction same as that of the photoreceptor 1 as shown by the arrow mark. In the toner rearrangement process, the toner contaminating on the electro-conductive belt 10C is detected by the toner sensor 20 arranged at the upper site of the electrode 10.

In the example of FIG. 7, the surface of the electrode 10 facing to the photoreceptor 1 at the time of the toner rearrangement is continuously transferred to the detection position detected by the toner sensor 20 so that the toner on the electrode 10 is continuously detected.

Figure 8:
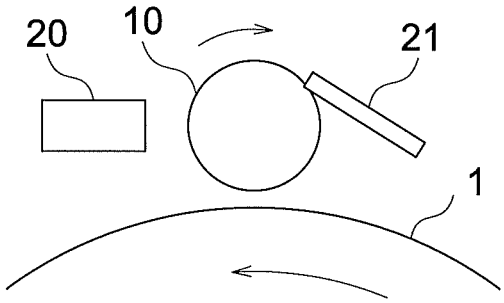
FIG. 8 shows a drawing of an example of the electrode 10.

FIG. 8 shows an embodiment of the electrode 10. In the embodiment shown in FIG. 8, the electrode cleaning device for cleaning the electrode 10 is constituted by a cleaning member 21 for performing mechanical cleaning. 21 is the electrode cleaning member constituted by a blade for removing the toner from the electrode 10. The electrode 10 rearranges toner in the state of cleaned by the cleaning member 21. Though the toner can contaminate onto the rod-shaped electrode 10 composed of metal; the contaminating toner can be continuously detected by the toner sensor 20 by rotating the electrode 10.

The concentration of the toner detected by the toner sensor 20 is read about every sheet of the image formation, for example. In the example shown in FIG. 8, the electrode 10 rearrange the toner always in the cleaned state and the toner sensor 20 detects the toner contaminating in the just before toner rearrangement process.

By the use of the embodiment shown in FIG. 8, the toner contamination onto the electrode 10 is detected on real time. In such the case, accordingly, the electrode condition preventing the toner contamination can be highly accurately set by feed backing the detecting result of the toner sensor 20.

Figure 9:
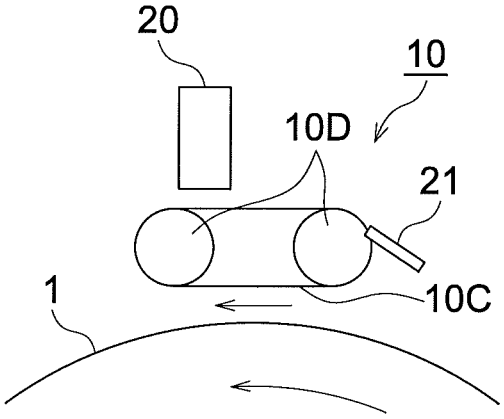
FIG. 9 shows a drawing of an example of the electrode 10.

FIG. 9 shows the example using the electro-conductive 10C the same as in FIG. 7, and the electro-conductive belt 10C is continuously cleaned by the cleaning member 21.

Figure 10:
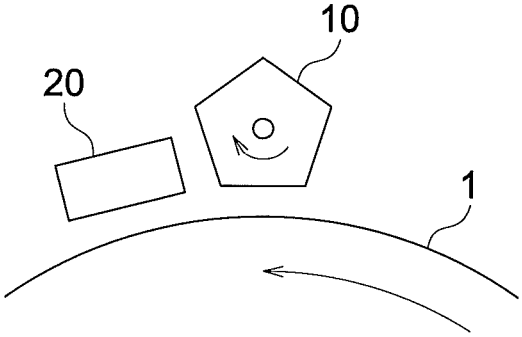
FIG. 10 shows a drawing of an example of the electrode 10.

The electrode 10 shown in FIG. 10 is composed of a rod-shaped member having a pentagonal cross section. The toner rearrangement is carried out in a state of that one of the surfaces of the pentagonal rod-shaped electrode is faced to the outer surface of the photoreceptor 1. The electrode 10 is rotated as displayed by the arrow mark and the toner on the surface after the toner rearrangement is detected by the toner sensor 20 on every time of finishing a designated number of the sheet (several tens sheets for example). The electrode 10 in FIG. 10 is rotated at the time of the contaminating toner detection on ST5 in FIG. 4. As above-described, the surface of the electrode 10 facing to the photoreceptor 1 at the time of the toner rearrangement is intermittently transferred to the position where the contaminating toner is detected.

Figure 11:
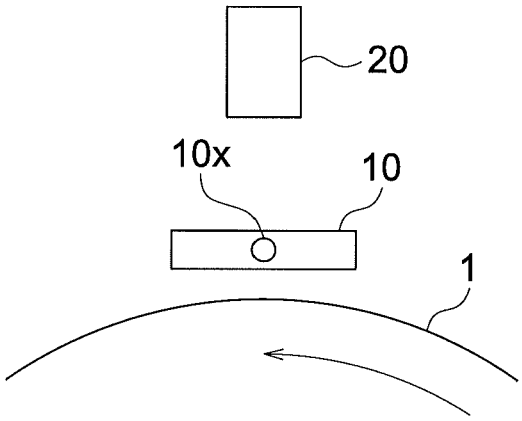
FIG. 11 shows a drawing of an example of the electrode 10.
Figure 12A:
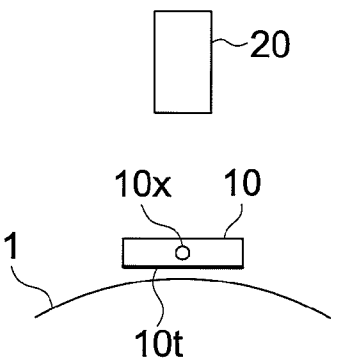
FIGS. 12*a*, 12*b*, 12*e*, and 12*d* show drawings of examples of the electrode 10.
Figure 12B:
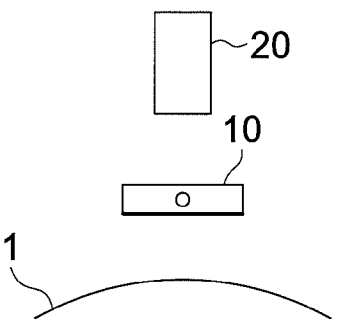
Figure 12C:
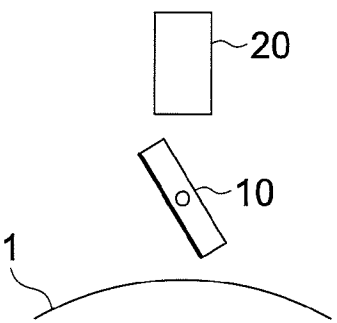
Figure 12D:
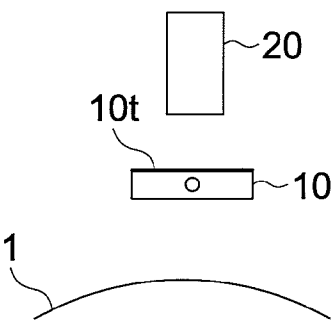

FIGS. 11 and 12 each display an example of the electrode 10 and the action of it, respectively.

In the example in FIGS. 11 and 12, the plate-shaped electrode 10 is constituted so as to be rotatable around the axis 10*x* and movable as shown in FIG. 12. The toner sensor 20 is arranged at an upper site of the electrode 10. The toner rearrangement in the state of that the electrode 10 is neared to photoreceptor 1 as shown in FIG. 12*a*. When the toner on the electrode 10 is detected, the electrode 10 is raised to the intermediate position between the surface of the photoreceptor 1 and the toner sensor 20 as shown in FIG. 12*b*. After that, the electrode 10 is rotated as shown in FIG. 12*c* so that the toner contaminating surface 10*t* faces to upper direction as shown in FIG. 12*d*. The toner on the electrode 10 is detected by the toner sensor 20 in the state shown in FIG. 12*d*.

The toner detection by the rotation and movement of the electrode 10 shown in FIG. 12 is carried out on the step of ST5 in FIG. 4.

Figure 13:
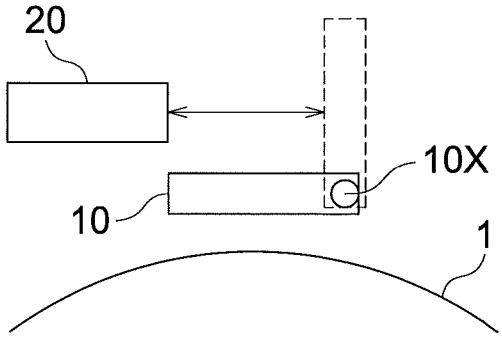
FIG. 13 shows a drawing of an example of the electrode 10.

The electrode 10 shown in FIG. 13 is a plate-shaped member rotatable around the center axis 10*x*, and the toner rearrangement is carried out in the state shown by the solid line almost parallel with the outer surface of the photoreceptor 1. The electrode 10 is rotated to the position shown by the broken line at every time of finishing the designated number of the sheet of image formation, and the toner on the electrode 10 is detected by the toner sensor 20.

Figure 14:
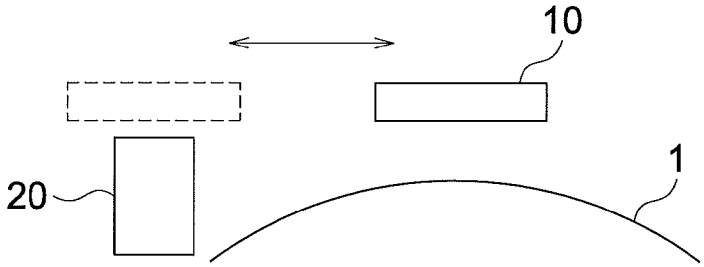
FIG. 14 shows a drawing of an example of the electrode 10.

In the example of FIG. 14, the electrode 10 is movable as displayed by the arrow mark, and the toner rearrangement is carried out in the state of the electrode 10 shown by the solid line, and the toner on the electrode 10 is detected by the toner sensor 20 in the state of the electrode 10 shown by the broken line.

Figure 15:
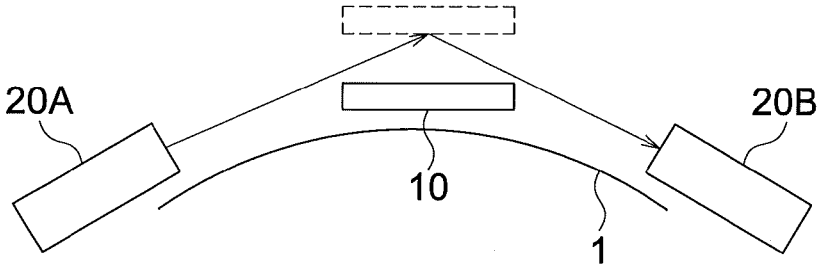
FIG. 15 shows a drawing of an example of the electrode 10.

In the example of FIG. 15, the electrode 10 is movable between the position neared to the photoreceptor 1 shown by the solid line and the position far from the detecting position shown by the broken line. The toner sensor comprises the light emitting element 20A and the light receiving element 20B. The light emitting element 10A and the light receiving element 10B are arranged so as to detect the toner on the electrode 10 being at the detecting position shown by the broken line. The toner rearrangement is carried out in the state shown by the solid line and the toner is detected by the toner sensor in the state shown by the broken line.

The examples shown in FIGS. 12 to 15, the surface of the electrode 10 surfaced on the occasion of the toner rearrangement is each intermittently transferred to the detecting position where the toner on the electrode 10 is detected.

EXAMPLES (1) Common Conditions

Environment: NN

Photoreceptor diameter: 60 mm

Developing roller diameter: 25 mm

Surface speed of developing roller: 720 mm/min(Reversal rotating development)

Distance between developing roller and photoreceptor: 0.30 mm

Carrying amount of toner on developing roller: 220 g/m$^2$

Image forming apparatus: Monochromatic 80 ppm machine (Processing speed: 400 mm/s)

Toner diameter: 6.5 μm

Carrier diameter: 33 μm

Toner concentration: 7% by weight

Developer amount in developing device: 1,000 g (2) Examples

Example 1

Electrode: Electrode 10 of FIG. 1; Rod-shaped electrode with circular cross section

Example 2

Electrode: Electrode 10 FIG. 7; Electro-conductive belt 10C

Example 3

Electrode: Pentagonal electrode 10 shown in FIG. 10

Example 4

Electrode: Plate-shaped electrode 10 shown in FIGS. 11 and 12

Comparative Example 1

Plate-shaped electrode was used, and the toner rearrangement was carried out under a fixed condition without toner detection and control.

In Examples 1 to 4, the contaminating toner detection, feed backing of the detected results to the electrode condition and the electrode cleaning were performed.

An image having a printed ratio of 5% and that having a printed ratio of 30% were each subjected to Examples 1 to 4 and Comparative example 1, which were referred to as Test 1 and Test 2, respectively.

Example 5

Electrode: Electrode 10 of FIG. 8 and cleaning member 21 were used.

Example 6

Electrode: Electro-conductive belt 10 of FIG. 9 and cleaning member 21 were used.

Comparative Example 2

Electrode 10: Electro-conductive belt 10C of FIG. 9 and cleaning member 21 were used.

In Examples 5 and 6, the toner detection and the control based on the results of the contaminating toner detection were applied, and both of them were not applied in Comparative example 2.

An image having a printed ratio of 5% and that having a printed ratio of 30% were each subjected to Examples 1 to 6 and Comparative examples 1 and 2, which were referred to as Test 1 to Test 4, respectively.

[Test No. 1 and 2 (Examples 1 to 4, Comparative Example 1)]

Rearrangement electrode condition at the initial time a:

Direct current voltage: −600 V

Alternating current peak voltage: 1.3 kV

Frequency f=9 kHz

Photo receptor/electrode gap=0.15 mm

[Test No. 3 and 4 (Examples 5 and 6, Comparative Example 2)]

Rearrangement electrode condition at the initial time a:

Direct current voltage: −600 V

Alternating current peak voltage: 2.5 kV

Frequency f=9 kHz

Photo receptor/electrode gap=0.30 mm

Pattern for evaluation of roughening and sweeping mark:

Line screen of 200 lpi with writing pdi of 600

Concentration data=180/255

Results of Tests 1 and 2, and those of Tests 3 and 4 are each listed in Table 1 and table 2, respectively.

After one of the test, the developer was replaced and the electrodes were each cleaned before the next test.

TABLE 1

| | | Printed | Sweeping | | | | | Roughening | | | | |
|---|---|---|---|---|---|---|---|---|---|---|---|---|
| Test No. | Printed ratio | sheet number | Example 1 | Example 2 | Example 5 | Example 6 | Comparative example 1 | Example 1 | Example 2 | Example 5 | Example 6 | Comparative example 1 |
| 1 | 5% | 10000p | A | A | A | A | B | A | A | A | A | B |
| 2 | 30% | 10000p | A | A | A | A | B | A | A | A | A | B |

A: OK

B: NG

TABLE 2

| Test No. | Printed ratio | Printed sheet number | Sweeping Example 3 | Sweeping Example 4 | Sweeping Comparative example 2 | Roughening Example 3 | Roughening Example 4 | Roughening Comparative example 2 |
|---|---|---|---|---|---|---|---|---|
| 3 | 5% | 10000p | A | A | B | A | A | B |
| 4 | 30% | 10000p | A | A | B | A | A | B |

A: OK
B: NG

As shown in Tables 1 and 2, the sweeping mark and roughening were not caused in any of Examples 1 to 6 and high quality images can be formed, but Comparative examples 1 and 2 were unacceptable since both of the sweeping mark and roughening were caused.

[Another Embodiment 1]

Figure 16:
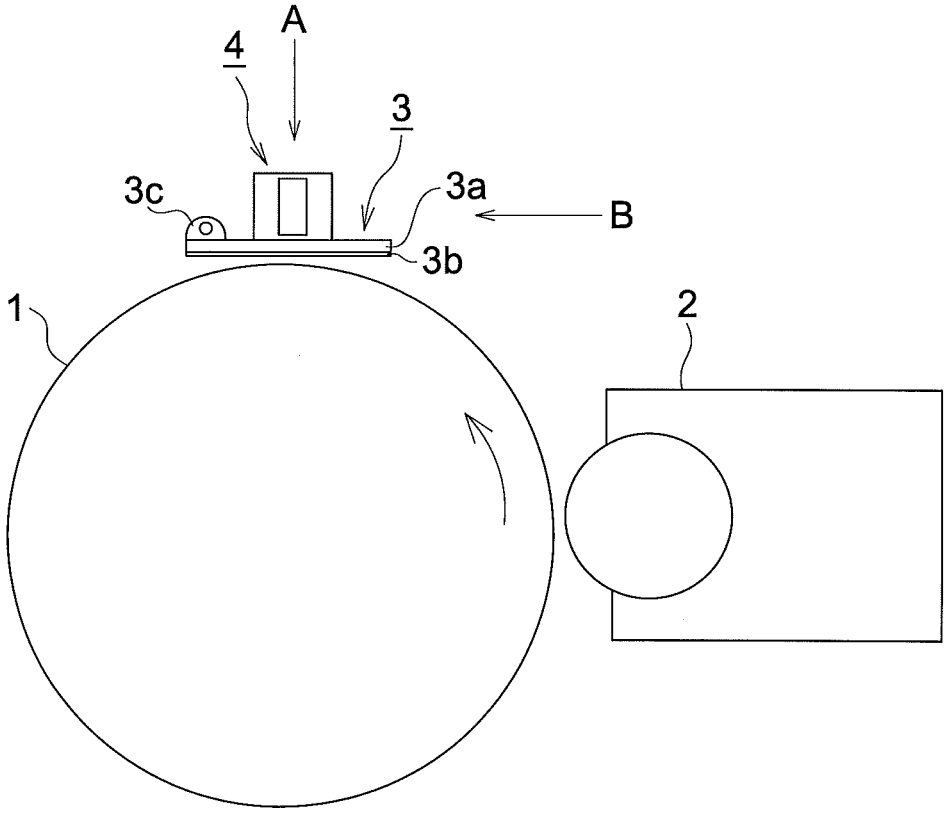
FIG. 16 shows a cross section displaying the whole constitution of the image forming apparatus relating to another embodiment 1.

Other embodiment is described referring FIGS. 16 to 20. In FIG. 16, 1 is a photoreceptor drum which is rotated anticlockwise. Electrostatic latent images formed by a means not shown in the drawing on the photoreceptor drum 1 are developed to toner images by a developing device 2. A toner rearranging electrode 3 is provided on the downstream side of the developing device 2 so as to face to the photoreceptor drum 1.

The toner rearranging electrode 3 is a glass substrate 3 having a length capable of covering the whole axis direction width of the photoreceptor drum on which a transparent electrode 3*b* of ITO (indium tin oxide) is formed. To the transparent electrode 3*b*, alternating current voltage is applied from a electric power source not shown in the drawing.

The toner rearranging transparent electrode 3*b* may be one which is transparent at the portion near the detecting position, though the electrode may be wholly transparent.

A toner contamination detecting device comprises an optical device 4. The optical sensor 4 is provided at a position which is on the backside of the toner rearranging electrode and the center of the whole width of the photoreceptor 1, and the photoreceptor 1 and the toner rearranging electrode 3 are the most neared at this position. The optical sensor 4 is preferably arranged in unified and contacted in unified state on the backside of the toner rearranging electrode 3. Lowering in the ability of the sensor caused by entering of scattered toner can be prevented by such the constitution.

Figure 17A:
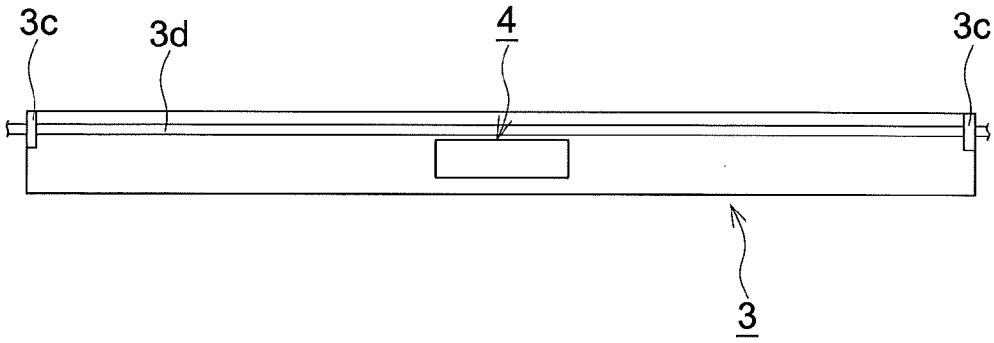
FIG. 17*a* shows a plan view of the toner rearranging electrode of FIG. 16 viewed from arrow A.
Figure 17B:
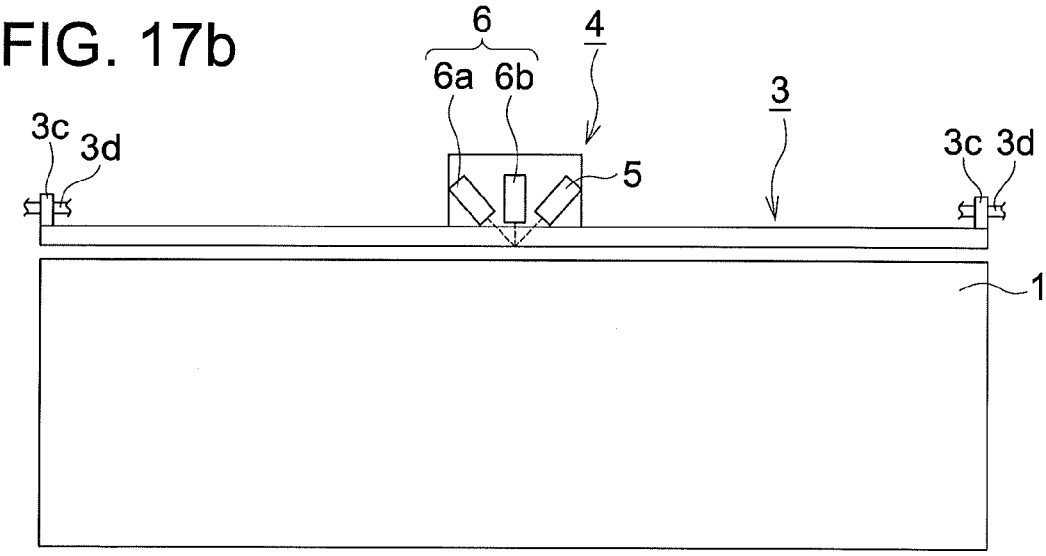
FIG. 17*b* shows a side view of the toner rearranging electrode of FIG. 16 viewed from arrow B.

The optical sensor 4 is constituted by a pair of a light emission elements 5 such as a LED and a light receiving element 6 such as a photodiode. In FIG. 17, the light receiving element 6*a* for a black toner and the light receiving element 6*b* for a color toner are both displayed; however, one of them is used in the practical use. The output of the light receiving element is input to a controlling section not shown in the drawing.

The light emission element 5 is arranged so as to make the incidence angle to 45°, and the wavelength of the light emitted from the light emission element 5 may be 950 nm for the black toner and 780 nm for the color toner.

In the case of the black toner, the light receiving element 6*a* is arrange at an oblique angle of 45° so as to receive the specular light from the photoreceptor drum 1. Namely, the device is constituted so that the receiving light amount is largest when no contaminating on the toner rearranging electrode 3 and is lowered accompanied with the progression of the contaminating. On the other hand, in the case of the color toner, the light receiving element 6*b* is arranged to be face at a right angle to the photoreceptor drum so as to receive the diffused light from the toner contamination on the toner rearranging electrode 3. Therefore, the receiving light amount is raised accompanied with the progression of the toner contamination.

In the case of the black toner, the position detecting the specular light is suitable since such the toner almost does not cause diffuse reflection; therefore, the light receiving element receives the specular light from the photoreceptor 1. On such the occasion, the light is twice blocked by the contaminating toner, at the times of going toward the photoreceptor drum 1 and reflected from the photoreceptor, when the toner rearranging electrode is contaminated by the toner. Therefore, the contaminated condition can be more exactly detected. On the other hand, the light receiving element 6*b* is arranged at the position for detecting the diffuse reflected component since the color toner easily causes diffuse reflection and variation in the specular component is smaller as to the toner amount.

In FIG. 16, the toner rearranging electrode 3 has rotatable supporters 3*c* at the both ends thereof, and is constituted so that the electrode is rotatable around the axis 3*d* (refer FIG. 17) holding the rotatable supporters 3*c*. When the controlling section judges that the contamination is caused according to the signals from the optical sensor 4, a warning informing the occurrence of contamination is displayed on a operation panel. The operator can rotate the toner rearranging electrode 3 around the axis 3*d* for cleaning the contamination on the transparent electrode 3*b*.

The rotation around the axis 3 can be automatically performed, and the physical cleaning can be automatically performed by constituting the apparatus so that a cleaning means can be moved in parallel with the axis of the photoreceptor drum 1 along the released transparent electrode 3. The toner rearranging electrode 3 can be positioned by providing a stopper (not shown in the drawing).

Besides, the transparent electrode 3 can be electro-statically, not physically, cleaned. The electro-static cleaning can be performed by applying a voltage higher than the alternating current voltage on the occasion of the toner rearrangement to the transparent electrode 3*b* to forcibly return the toner to the photoreceptor drum 1.

An example of the voltage to be applied to the toner rearranging electrode is shown below.

| | DC component | AC component |
|---|---|---|
| For toner rearrangement | −600 V | 2.5 kVpp |
| For electro-statical cleaning | −1000 V | 2.5 kVpp |

In the above, pp expresses the peak to peak value of the unit of the AC component.

Figure 18:
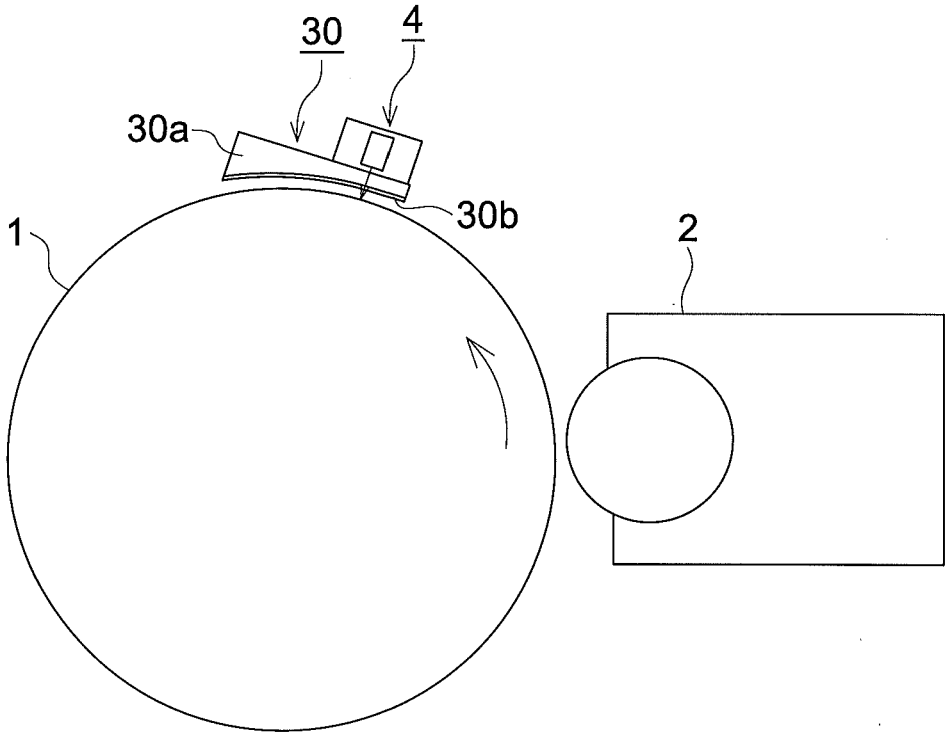
FIG. 18 shows a cross section of the toner rearranging electrode of the modified embodiment of another embodiment 1.

FIG. 18 shows a schematic cross section of an example of the toner rearranging electrode in the Another embodiment 1. In the drawing, the surface of the toner rearranging electrode 30 on which the transparent electrode 3*b* facing to the photoreceptor drum 1 is made as a curved surface so that the space between the transparent electrode 3*b* and the photoreceptor drum 1 is held constantly over the whole area of the toner rearranging electrode. By constituting such the curved surface, the zone for the toner rearrangement can be made larger so that the efficiency of toner rearrangement can be raised. The thickness of the toner rearranging electrode is gradually raised from the upper stream side to lower stream side of the rotation direction of the photoreceptor drum 1, and the optical sensor 4 is arranged at the upper stream end of the toner rearranging electrode where the occurrence of contamination is largest.

Figure 19:
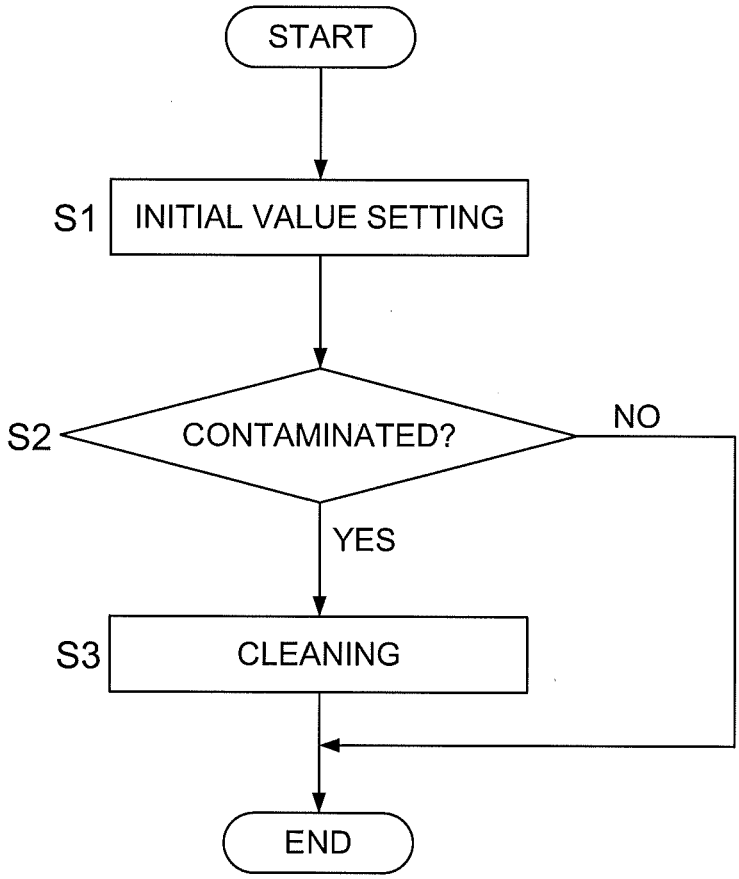
FIG. 19 shows a flow chart of the controlling of another embodiment.

The control of the toner rearranging electrode by using the constitution of the above embodiment or a variation thereof is described referring FIG. 4. FIG. 19 is a flowchart of subroutine executed by the main routine of the controlling section (not shown in the drawing) on every designated timing in a case of that the cleaning (electro-statical cleaning or physical cleaning) is performed when the toner contamination is detected.

The designated timing of the contamination detection is described below. The designated timing can be roughly classified into two kinds. One of them is a case in which an exclusive detection mode is provided at the time without the job acting time for executing the subroutine. Another one is a case in which the contamination detection is performed during the performing of the job.

In the case of that the exclusive detection mode outside of the job acting time is provided, a toner image for detecting is formed since any image is not formed on the photoreceptor drum 1 and the then the rearrangement of the image is carried out. After that, the contamination on the toner rearranging electrode is detected.

Besides, the image for detection is not necessarily formed when the detection is carried out during the job action since the toner image by the job is formed. The detection during the job action is carried out after printing of designated sheets of the image or printing of designated number of pixels, the detection may be carried out about every print when further perfection is required. When the job requires many prints, the detection is performed as to every designated number of the prints. The contamination detection in the course of the job is performed at the time when the area between the images (referred to as inter image area) is passed through the position of the toner rearranging electrode. Moreover, the job is once discontinued for performing the cleaning when the cleaning is made necessary as a result of the contamination detection during the execution of one job. When the remaining sheet number to be printed is small, the cleaning may be performed after finishing of the job.

The flowchart of FIG. 19 is described below. Firstly, on the step S1, the initial value of the alternating current voltage for toner rearrangement (V2*dc*0 of the DC component and V2*ac*0 of the AC component) is registered in the register of the CPU. The register decides the toner rearranging voltage referring the subroutine for performing the printing. The initial value V2*dc*0 is set at the half value of the sum of the voltage of the developing roller V1*dc* and the charged potential of the photoreceptor drum V0. The initial value V2*ac*0 is a previously designate fixed value. The initial values are experimentally confirmed as the value at which the toner rearranging effect can be maximally displayed and the toner contamination is almost not caused under usually using conditions.

The contamination detection is carried out on the step S2 and the level of toner contamination is judged based on the output of the optical sensor 4. When it is judged that the toner contamination level is not lower than the designated value ("Yes" on the step S2), the cleaning is carried out on the step S3. The cleaning may be the foregoing electrostatic cleaning or physical automatic cleaning.

The subroutine is completed when the toner contamination level is lower than the designated value on the step S2 ("No" on the step 2) or after completion of the cleaning on the step S3, and the processing is returned to the main routine. On the main routine, the printing action is performed by a known method. On such the occasion, the toner rearranging electrode is driven at the voltage registered in the foregoing register.

In the above, the cleaning is carried out on the step S3; however, it may be, more simply, that the warning of toner contamination is displayed only on the panel of the image forming apparatus. The operator can perform the cleaning by manual operation by looking the warning. Such the warning-manual cleaning system is advantageous when the toner rearranging function is installed in the cheep apparatus such as a printer.

Figure 20:
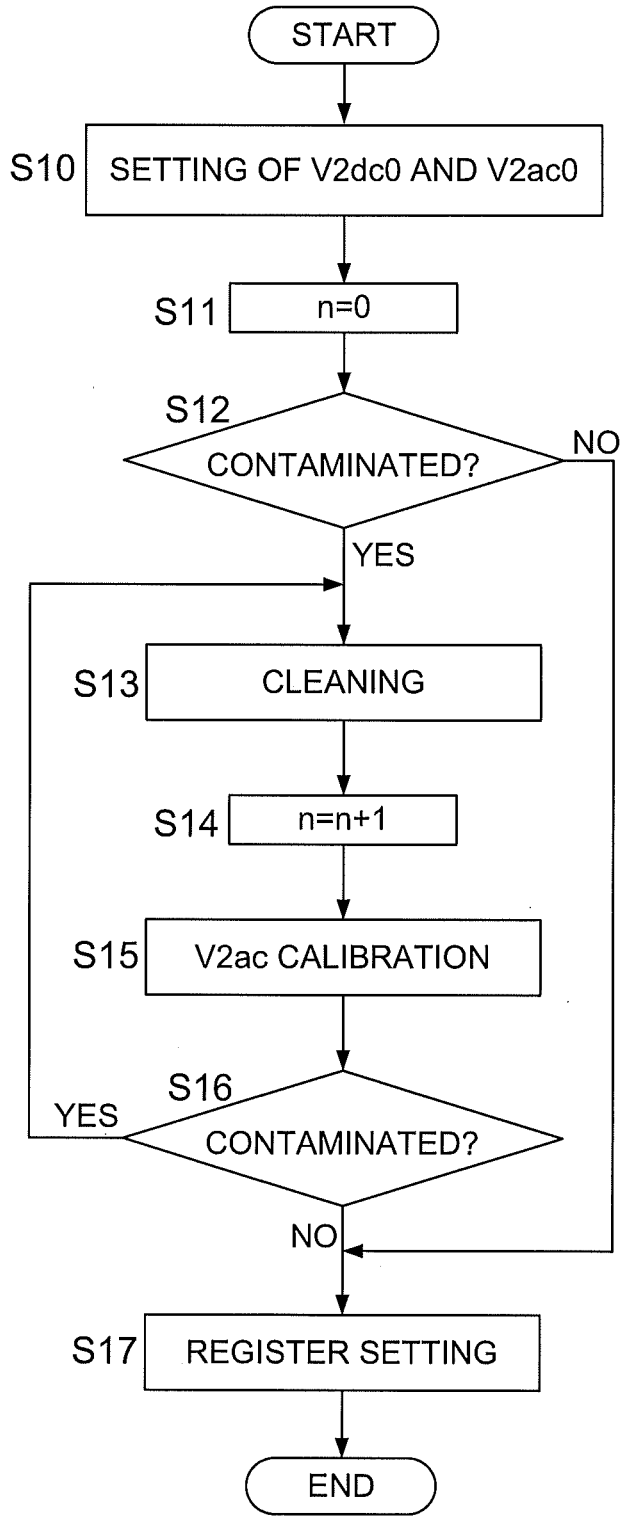
FIG. 20 shows a flow chart of the controlling of the modified embodiment of another embodiment.

FIG. 20 shows a flowchart of a modified example for suitably controlling the toner rearranging voltage while executing the contamination detection, and performing the cleaning according to necessity.

In FIG. 20, the initial values (V2*dc*0 of the DC component and V2*ac*0 of the AC component) are firstly set on the step S10 and registered in the register of the CPU. The register is referred in the subroutine for performing the printing and sets the toner rearranging voltage. The initial value V2*dc*0 is set at the half value of the sum of the voltage of the developing roller V1*dc* and the charged potential of the photoreceptor drum V0. The initial value V2*ac*0 is the value of the alternating current component which is set in the previous routine and applied at present. In the control shown in FIG. 20, the value set in the previous processing is used as the initial value of the present processing for optimizing the toner rearranging voltage. The counter n is reset on the step S11.

Next, the contamination detection is carried out on the step S12. When the contamination level judged by the output of the optical sensor 4 is lower than the designated value, the processing is skipped to the step S17 and the values of the DC component and the AC component registered in the register are made to applicable in the subroutine for printing. When the processing is advanced from the step S12 to the step S17, the value of the resister is the same as the initial value.

Besides, in the case of that the contamination level is not less than the designated value; the cleaning is performed on the step S13. The cleaning may be the foregoing electrostatic cleaning or the physical automatic cleaning. Then the counter n is raised by "1" on the step S14 for calibrating the AC component V2*ac* of the toner rearranging electrode. The calibration is carried out by reducing the initial value by n×0.05 kV as follows.

$$V2acn \leftarrow V2ac0 - n \times 0.05 \text{ (kV)}$$

And the toner detection of the toner rearranging electrode at the calibrated value is performed on the step S16. The contamination detection on the step 16 is carried out after that a toner patch for detection is prepared and subjected to the toner rearranging treatment.

The above-mentioned calibration and the contamination detection on the steps S13 to S16 are carried out until the toner contamination detected on the step S16 is made lower that the designated value, and the calibrated value of the AC component V2*ac* of the rearranging voltage is set in the register so that the value is applicable in the subroutine for performing the printing.

In the above-mentioned control FIG. 20, the AC component is reduced by the value not causing the contamination when the toner contamination detected by the contamination detection is not less than the designated value. Therefore, the maximum rearranging voltage within the range of not causing the toner contamination can be applied and the maximum effect of the toner rearrangement can be displayed.

In FIG. 20, the calibration of the toner rearranging voltage is performed by calibrating on the peak to peak value of the AC component; however, the calibration may be performed by controlling the frequency f of the AC component or the duty ratio (the ratio of the pulse width on positive side to the pulse frequency). In the case of the frequency F control, the control is carried out by raising the frequency, and in the case of the duty ratio control, the calibration is carried out by lowering the duty ratio. Moreover, the DC component of the alternating current voltage can be also controlled. In the case of the DC component control, the DC voltage is controlled by raising the absolute value (in the case reversal development by negative charge).

[Another Embodiment 2]

Figure 21:
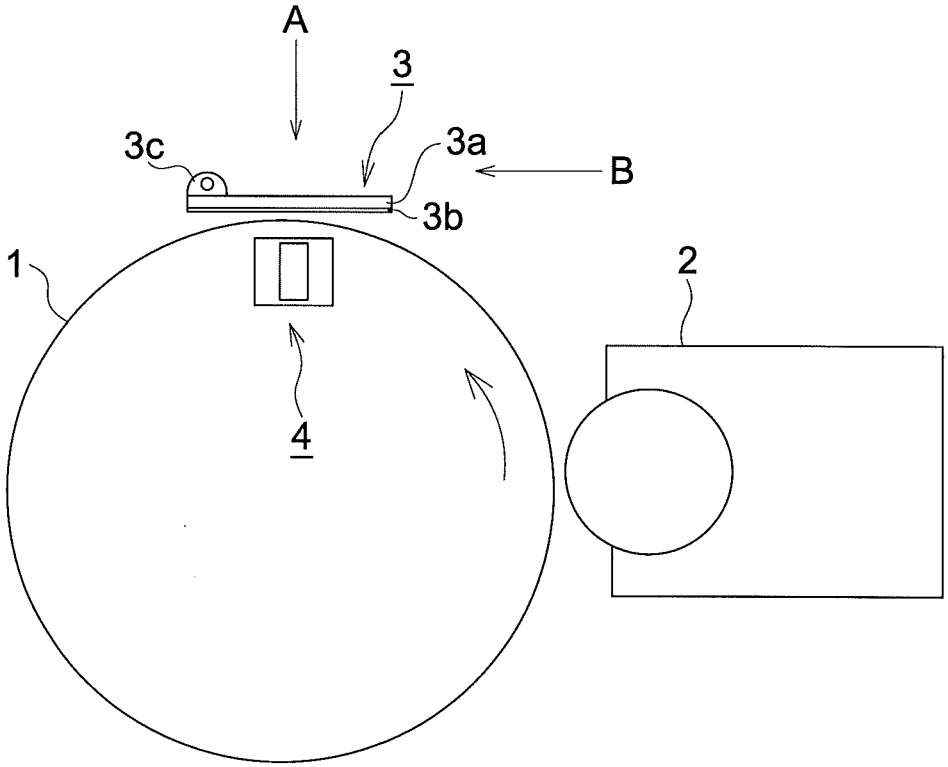
FIG. 21 shows a cross section displaying the whole constitution of the image forming apparatus relating to another embodiment 2.
Figure 22A:
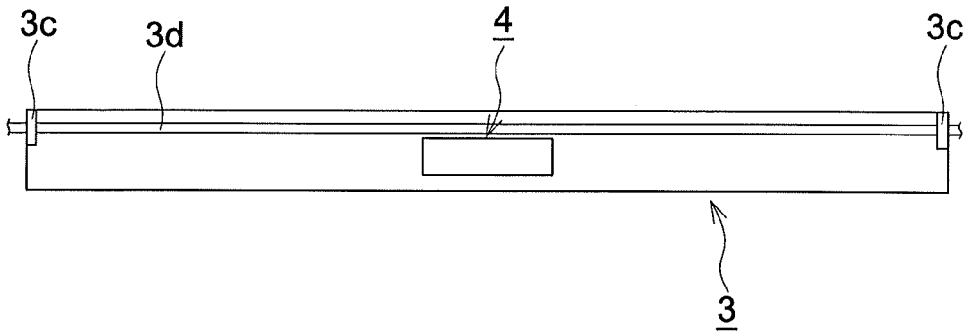
FIG. 22*a* shows a plan view of the toner rearranging electrode of FIG. 21 from the arrow A.
Figure 22B:
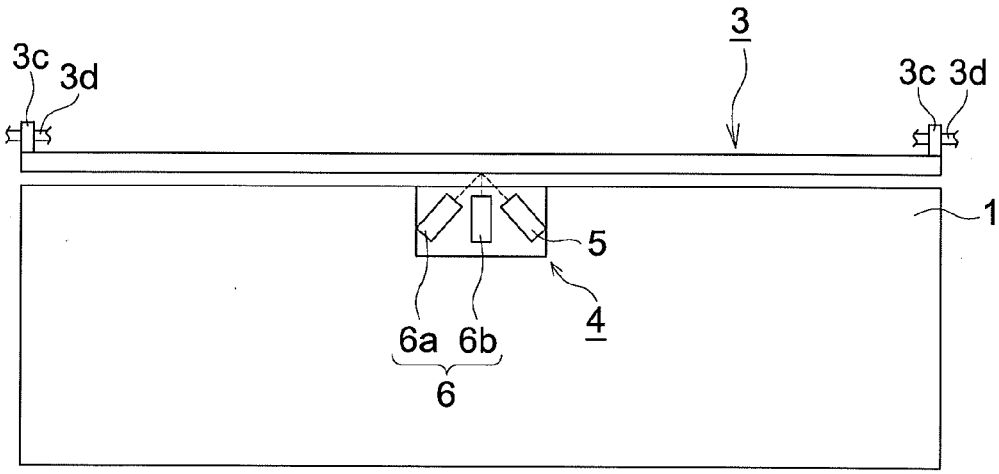
FIG. 22*b* shows a side view of the toner rearranging electrode of FIG. 21 from the arrow B.
Figure 23:
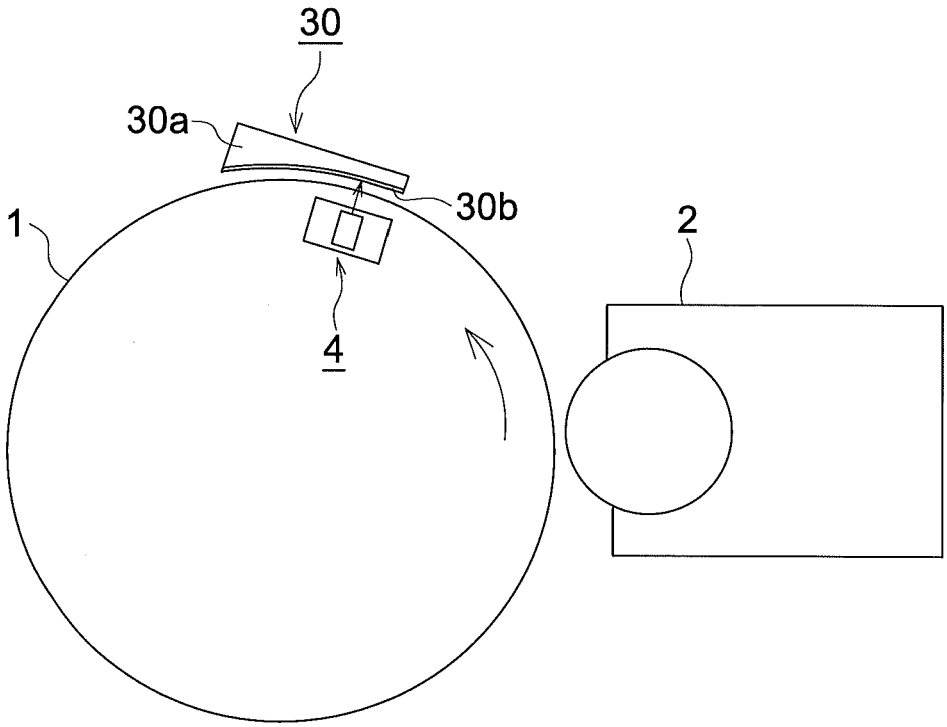
FIG. 23 shows a cross section of the toner rearranging electrode of the modified embodiment of another embodiment 2.

Another embodiment 2 is described referring FIGS. 21 to 23. In FIG. 21, 1 is a transparent photoreceptor drum which is driven anti-clockwise. The transparent photoreceptor drum 1 is constituted by providing a transparent electro-conductive layer such as ITO (indium tin oxide) on a transparent substrate such as polycarbonate and providing a photosensitive layer on the electro-conductive layer. An image formed on the transparent photoreceptor drum by a means not shown in the drawing is converted to a toner image by a developing device 2. A toner rearranging electrode 3 facing to the transparent photoreceptor drum is arranged on the downstream side of the developing device 2.

The toner rearranging electrode 3 is constituted by providing an electrode 3*a* on a substrate 3*a* having a length covering the whole width in the axis direction of the transparent photoreceptor drum 1. Alternative electric current is applied from a electric power source not described in the drawing.

An optical sensor 4 is arranged at the position of inside the transparent photoreceptor drum 1 and facing to the toner rearranging electrode. The optical sensor 4 is arranged at the center of the whole width of the toner rearranging electrode 3 so that the toner rearranging electrode is faced to the position where the transparent photoreceptor drum 1 and the toner rearranging electrode 3 are the most neared in the rotating direction of the transparent photoreceptor drum 1.

In FIG. 21, the toner rearranging electrode 3 has rotatable holding portion 3*c* on both ends thereof and is constituted so as to be rotatable around an axis 3*b* holding the rotatable holding portions refer FIGS. 22A and 22B). When the controlling section judges according to the signals from the optical sensor 4 that the toner contamination is caused, warning informing the occurrence of the toner contamination is displayed on the operation panel. According to the warning, the operator can clean the contamination of the electrode 3*b* by rotating the toner rearranging electrode around the axis 3*d*.

FIG. 23 shows the schematic drawing of the cross section of the toner rearranging electrode of the another embodiment 2 of the invention. In the drawing, the surface of the toner rearranging electrode 30, which is faced to the transparent photoreceptor drum and the electrode 30*b* is formed thereon is made a curved face so that the distance to the transparent photoreceptor drum is identical over the whole are of the electrode. By constituting such the curved face electrode, the long area for toner rearranging the toner on the transparent photoreceptor 1 can be held so that the efficiency of the toner rearrangement is raised. The optical sensor 4 is arranged at the upper stream end portion of the toner rearranging electrode where the occurrence of the toner contamination is the highest. The description of the functions and the controlling method of each of the parts in the another embodiment 2 is omitted since they are the same as that in the Another embodiment 1.

In the invention, the contamination of toner onto the electrode for rearranging the toner is detected and the state of the toner rearranging electrode is made to that without contamination of any toner based on the detection result, and the toner is rearranged in the state without toner contamination to form the image. By such the processing, phenomena causing the lowering in the image quality such as sweeping marks and roughening are prevented and the high quality image can be stably formed.

What is claimed is:

1. An image forming apparatus comprising:

an image carrier;

a latent image forming device for forming an electrostatic latent image on the image carrier;

a developing device for developing the electrostatic latent image carried on the image carrier to form a toner image on the image carrier;

an electrode which is arranged downstream of the developing device in a moving direction of the image carrier and faces to the image carrier;

an electric power source which applies a voltage comprising an alternating current voltage to the electrode;

a toner contamination detecting device for detecting toner contamination onto the electrode;

an electrode cleaning device for cleaning the electrode; and a controlling section, wherein the controlling section controls the electric power source to apply a voltage comprising an alternating current voltage to the electrode so that the toner image is rearranged by reciprocally moving toner of the toner image between the image carrier and the electrode and allows the electrode cleaning device to clean the electrode when the toner contamination detecting device detects toner contamination on the electrode, and performs the toner rearrangement by the electrode from which the toner contamination is removed;

wherein the electrode cleaning device applies an electric voltage comprising an alternating current voltage applied by the electric power source, and the controlling section controls the electric power source according to a detected result of the toner contamination onto the electrode detected by the toner contamination detecting device and thereby controls an electrode condition of the electrode while rearranging the toner; and wherein the control of the electrode condition includes a control on a peak voltage and a frequency of the voltage comprising the alternating current voltage.

2. The image forming apparatus of claim 1, wherein the toner contamination detecting device has a toner sensor for detecting the toner on the electrode.

3. The image forming apparatus of claim 1, wherein the electrode cleaning device has a cleaning member for mechanically removing the toner on the electrode.

4. The image forming apparatus of claim 1, wherein the electrode cleaning device applies a voltage comprising an alternating current voltage applied by the electric power source so as to electrically release the toner on the electrode from the electrode by the electric voltage applied by the electric power source.

5. The image forming apparatus of claim 1, wherein the controlling section allows the toner contamination detecting device to detect the toner contamination onto the electrode every designated number of image formings to clean the electrode.

6. An image forming apparatus comprising:

an image carrier;

a latent image forming device for forming an electrostatic latent image on the image carrier;

a developing device for developing the electrostatic latent image carried on the image carrier to form a toner image on the image carrier;

an electrode which is arranged downstream of the developing device in a moving direction of the image carrier and faces to the image carrier;

an electric power source which applies a voltage comprising an alternating current voltage to the electrode, a toner contamination detecting device for detecting toner contamination onto the electrode;

an electrode cleaning device for cleaning the electrode; and a controlling section, wherein the controlling section controls the electric power source to apply a voltage comprising an alternating current voltage to the electrode so that the toner image is rearranged by reciprocally moving toner of the toner image between the image carrier and the electrode and allows the electrode cleaning device to clean the electrode when the toner contamination detecting device detects toner contamination on the electrode, and performs the toner rearrangement by the electrode from which the toner contamination is removed;

wherein the electrode cleaning device applies an electric voltage comprising an alternating current voltage applied by the electric power source, and the controlling section controls the electric power source according to a detected result of the toner contamination onto the electrode detected by the toner contamination detecting device and thereby controls an electrode condition of the electrode while rearranging the toner; and wherein the control section controls the electric power source to apply a direct current voltage overlapped with the alternating current voltage to the electrode and the control of the electrode condition includes a control on the direct current voltage.

7. The image forming apparatus of claim 6, wherein the toner contamination detecting device has a toner sensor for detecting the toner on the electrode.

8. The image forming apparatus of claim 6, wherein cleaning device has a cleaning member for mechanically removing the toner on the electrode.

9. The image forming apparatus of claim 6, wherein the electrode cleaning device applies a voltage comprising an alternating current voltage applied by the electric power source so as to electrically release the toner on the electrode from the electrode by the electric voltage applied by the electric power source.

10. The image forming apparatus of claim 6, wherein the controlling section allows the toner contamination detecting device to detect the toner contamination onto the electrode every designated number of image formings to clean the electrode.

11. An image forming apparatus comprising:

an image carrier;

a latent image forming device for forming an electrostatic latent image on the image carrier;

developing device for developing the electrostatic latent image carried on the image carrier to form a toner image on the image carrier;

an electrode which is arranged downstream of the developing device in a moving direction of the image carrier and faces to the image carrier;

an electric power source which applies a voltage comprising an alternating current voltage to the electrode;

a toner contamination detecting device for detecting toner contamination onto the electrode;

an electrode cleaning device for cleaning the electrode; and a controlling section, wherein the controlling section controls the electric power source to apply a voltage comprising an alternating current voltage to the electrode so that the toner image is rearranged by reciprocally moving toner of the toner image between the image carrier and the electrode and allows the electrode cleaning device to clean the electrode when the toner contamination detecting device detects toner contamination on the electrode, and performs the toner rearrangement by the electrode from which the toner contamination is removed;

wherein the electrode has a face which faces the image carrier on an occasion of the toner rearrangement, and the face is capable of being moved to a detecting position where the toner contamination is detected by the toner contamination detecting device.

12. The image forming apparatus of claim 11, wherein the face is continuously moved to the detecting position.

13. The image forming apparatus of claim 11 wherein the face is intermittently moved to the detecting position.

14. The image forming apparatus of claim 11, wherein the toner contamination detecting device has a toner sensor for detecting the toner on the electrode.

15. The image forming apparatus of claim 11, wherein the electrode cleaning device has a cleaning member for mechanically removing the toner on the electrode.

16. The image forming apparatus of claim 11, wherein the electrode cleaning device applies a voltage comprising an alternating current voltage applied by the electric power source so as to electrically release the toner on the electrode from the electrode by the electric voltage applied by the electric power source.

17. The image forming apparatus of claim 11, wherein the controlling section allows the toner contamination detecting device to detect the toner contamination onto the electrode every designated number of image formings to clean the electrode.

* * * * *